US006402316B1

(12) United States Patent
Ichinose

(10) Patent No.: US 6,402,316 B1
(45) Date of Patent: Jun. 11, 2002

(54) RECORDING MEDIUM, PRODUCTION PROCESS OF THE RECORDING MEDIUM, AND IMAGE FORMING PROCESS USING THE RECORDING MEDIUM

(75) Inventor: Hirofumi Ichinose, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/471,226

(22) Filed: Dec. 23, 1999

(30) Foreign Application Priority Data

Dec. 28, 1998 (JP) ..... 10-373139

(51) Int. Cl.[7] ..... B41J 2/01
(52) U.S. Cl. ..... 347/101
(58) Field of Search ..... 347/101, 105, 347/106, 107; 503/227; 428/195

(56) References Cited

U.S. PATENT DOCUMENTS

| | | | | |
|---|---|---|---|---|
| 4,869,957 A | * | 9/1989 | Vankerckhoven et al. | 428/235 |
| 5,071,823 A | | 12/1991 | Matsushita et al. | 503/227 |
| 5,087,527 A | * | 2/1992 | Shimura et al. | 428/488.4 |
| 5,360,780 A | | 11/1994 | Okumura et al. | 503/227 |
| 5,374,475 A | | 12/1994 | Wälchli | 428/304.4 |

FOREIGN PATENT DOCUMENTS

| | | | |
|---|---|---|---|
| EP | 0 827 840 A2 | 3/1998 | B41M/5/00 |
| EP | 0 858 905 A1 | 8/1998 | B41M/5/00 |
| EP | 0 933 226 A2 | 8/1999 | B41M/5/025 |
| JP | 58-136482 | 8/1983 | B41M/5/00 |
| JP | 2-31673 B2 | 12/1984 | B41M/5/00 |
| JP | 2-276670 | 11/1990 | B41M/5/00 |
| JP | 4-101880 | 4/1992 | B41M/5/00 |
| JP | 9-296067 | 11/1997 | C08J/9/28 |
| WO | WO 95/6564 | 3/1995 | B41M/3/12 |

OTHER PUBLICATIONS

Patent Abstract of Japan, vol. 012, No. 027, (M–662), Jan. 27, 1988 (with respect to JP 62–183380 of Aug. 11, 1987).

* cited by examiner

*Primary Examiner*—N. Le
*Assistant Examiner*—K. Feggins
(74) *Attorney, Agent, or Firm*—Fitzpatrick, Cella, Harper & Scinto

(57) ABSTRACT

A recording medium for use in ink-jet recording. The recording medium has a substrate and at least one porous resin layer formed on the substrate. The porous resin layer comprises heteromorphic microspheres formed of a thermoplastic resin. The invention also encompasses a process for producing a recording medium having at least one porous resin layer on a substrate. The process includes the steps of applying to the substrate a coating formulation comprising polymer colloid in which heteromorphic microspheres are dispersed, and drying the coating formulation at a temperature lower than the lowest film-forming temperature of the heteromorphic microspheres.

16 Claims, 4 Drawing Sheets

(×10000)

RECORDING MEDIUM, PRODUCTION PROCESS OF THE RECORDING MEDIUM, AND IMAGE FORMING PROCESS USING THE RECORDING MEDIUM

BACKGROUND OF THE INVENTION

1. Field of the Invention

The present invention relates to a recording medium, and particularly to a recording medium suitable for use in ink-jet recording systems, a production process thereof, and an image forming process using such a recording medium.

2. Related Background Art

An ink-jet recording system is a system that minute droplets of an ink are ejected by any one of various working principles to apply them to a recording medium such as paper, thereby making a record of images, characters and/or the like, and is being quickly spread in various applications because it has features that recording can be conducted at high speed and with a low noise, color images can be formed with ease, recording patterns are very flexible, and development and fixing process are unnecessary.

Further, it begins to be applied to a field of recording of full-color images because images formed by a multi-color ink-jet system are comparable in quality with multi-color prints by a plate making system and photoprints by a color photographic system, and such printed images can be obtained at lower cost than the usual multi-color prints and photoprints when the number of copies is small.

With the improvement in recordability such as speeding up and high definition of recording, and full-coloring of images in the ink-jet recording system, recording apparatus and recording methods have been improved, and recording media have also been required to have higher properties.

In order to enhance absorbency, coloring ability and resolution, there have been proposed a wide variety of recording media obtained by forming a porous layer with inorganic particles, for example, recording media, in which a porous layer comprising an alumina hydrate is provided on a substrate as described in Japanese Patent Application Laid-Open No. 2-276670.

As described in Japanese Patent Application Laid-Open No. 4-101880, recording media, in which a transparent ink-fixing layer formed of a resin capable of being dissolved in or swelled by a solvent contained in an ink is provided on a substrate, have also been proposed.

However, inks of the type that a dye component is dissolved in a solvent have heretofore been often used in the conventional ink-jet recording system.

When such a dye ink is used, the resulting print is naturally poor in light fastness and ozone fastness and hence Involves a problem that it undergoes fading or color change when it is stored for a long period of time. Therefore, as described in Japanese Patent Application Laid-Open No. 58-136482 and U.S. Pat. No. 5,374,475, there have been proposed recording media in which a porous layer comprising a thermoplastic polymeric material is provided on a substrate, and the porous layer is melted by the action of heat and pressure after printing to make it dense.

As described in Japanese Patent Publication No. 2-31673, there have also been proposed recording media having an ink-receiving layer of a two-layer structure that an inorganic pigment layer absorbing an ink in a great amount is formed on a substrate, and an ink-receiving layer comprising a thermoplastic polymer is provided as the outermost layer.

Japanese Patent Application Laid-Open No. 9-296067 has proposed recording media having an ink-receiving layer in which a great number of interstices are formed as pores among polymer particles.

However, the above-described prior art documents have involved the following problems. Namely, in the conventional recording media, the so-called slurry-like plastic pigment, which is prepared by subjecting at least one vinyl monomer to emulsion polymerization, or the like is suitably used. The fine particles generally used in the above-described Japanese Patent Application Laid-Open No. 58-136482, U.S. Pat. No. 5,374,475 and Japanese Patent Publication No. 2-31673 are spherical and uniformly arranged as illustrated in FIG. 6, and the ink absorbency of the recording media has been imparted by the interparticle pores.

A porous resin layer having pores formed among such spherical particles has an effect to absorb an ink impacted on the recording medium after ejection of the ink and make the diameter of dots formed uniform. As a result, a certain degree of resolution has been able to be achieved in an image formed therefrom.

When an amount of the ink to be ejected is increased upon printing for the purpose of increasing a printing speed, however, a solvent (water) in the ink cannot be fully absorbed in the pores formed in the recording medium, so that problems such as ink running and bleeding have arisen.

Therefore, it has been attempted to enhance ink absorbency by containing porous inorganic particles in a porous resin layer. In this case, it is difficult to control the mixing ratio of the thermoplastic resin particles to the porous inorganic particles contained therein. When the content of the porous inorganic particles is high, the amount of the ink absorbed is increased. However, the sufficient content lowers the strength of the porous resin layer, so that such problems that separation or defects are incurred in handling have been encountered upon the production of such a recording medium or formation of an image on the resulting recording medium.

According to the recording media described in Japanese Patent Application Laid-Open No. 9-296067, polymer particles in an emulsion are aggregated by instabilizing the emulsion before, upon the formation of an emulsion-containing layer, all water in the emulsion is vaporized out of the layer, the resultant layer is then dried, thereby causing interstices among the particles to remain as pores to provide a porous resin layer.

However, this process has involved a problem that since the aggregation is conducted by using a gelling agent before the drying, it is impossible to stably control the aggregation, so that-the degree of aggregation becomes varied, and as illustrated in FIG. 7, the size and number of the pores become uneven to partially produce portions low in absorbency and also to specifically produce large pore portions, whereby absorption of an ink is varied to make an optical density of image unstable.

SUMMARY OF THE INVENTION

With the foregoing problems in view, it is an object of the present invention to provide a recording medium which has good ink absorbency and little variation in the absorption of an ink and can provide clear and bright images high and even in optical density, and an image forming process using such a recording medium.

The above object can be achieved by the present invention described below.

According to the present invention, there is thus provided a recording medium comprising a substrate and at least one porous resin layer formed on the substrate, wherein the porous resin layer comprises heteromorphic microspheres.

According to the present invention, there is also provided a process for producing a recording medium having at least one porous resin layer on a substrate, which comprises the steps of applying a coating formulation comprising polymer colloid, in which heteromorphic microspheres are dispersed, to the Substrate, and drying the coating formulation at a temperature lower than the lowest film-forming temperature of the heteromorphic microspheres, thereby forming the porous resin layer.

According to the present invention, there is further provided an image forming process, comprising the step of ejecting an ink by an ink-jet recording system on the porous resin layer of the recording medium described above to conduct recording, and then heating the recording medium at a temperature not lower than the lowest film-forming temperature of the heteromorphic microspheres, from which the porous resin layer is formed, thereby forming the porous resin layer into a film.

According to the present invention, there is still further provided an image forming process, comprising the step of ejecting an ink by an ink-jet recording system on the porous resin layer of the recording medium described above to conduct recording, laminating the recording medium on a transfer-printing medium with the porous resin layer opposed to the transfer-printing medium, and then heating and pressing the recording medium at a temperature not lower than the lowest film-forming temperature of the heteromorphic microspheres, from which the porous resin layer is formed, from the side of the substrate of the recording medium, thereby transferring the porous resin layer to the transfer-printing medium.

According to the present invention, even and bulky pores can be stably formed in an ink-absorbing layer by arranging and bonding the resin particles in the form of a heteromorphic microsphere, thereby providing recording media which have high ink absorbency upon absorption of an ink and permit the formation of images having high and even optical density.

According to the present invention, there can be provided recording media which permits the provision of images having excellent water fastness and weather fastness and withstanding long-term storage, have a strong film and are easy to handle, and an image forming process which can actually achieve excellent image quality and permits the formation of an image by transfer printing The present invention has been led to completion by investigating the findings obtained by tests by the present inventors in further detail.

DESCRIPTION OF THE PREFERRED EMBODIMENTS

The embodiments of the present invention will hereinafter be described specifically.

Figure 1:
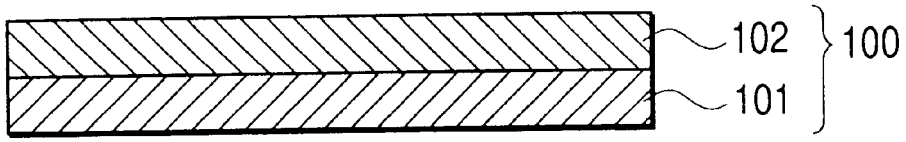
FIG. 1 is a schematic cross-sectional view illustrating an exemplary recording medium used in the present invention (EXAMPLES 1 to 3).
Figure 2:
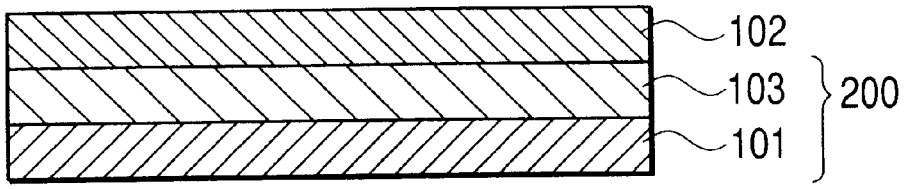
FIG. 2 is a schematic cross-sectional view illustrating an exemplary recording medium of a two-layer structure used in the present invention (EXAMPLE 4).
Figure 3:
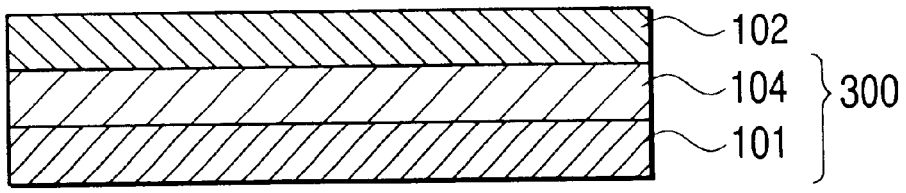
FIG. 3 is a schematic cross-sectional view illustrating another exemplary recording medium of a two-layer structure used in the present invention (EXAMPLE 5).

FIGS. 1 to 3 illustrate examples of the recording medium according to the present invention. In FIG. 1, reference numerals 101 and 102 indicate a substrate and a porous resin layer, respectively.

FIG. 2 illustrates an example where a porous inorganic particle layer 103 is provided between the substrate 101 and the porous resin layer 102. FIG. 3 illustrates an example where a hot-melt resin layer 104 is provided between the substrate 101 and the porous resin layer 102.

Figure 4A:
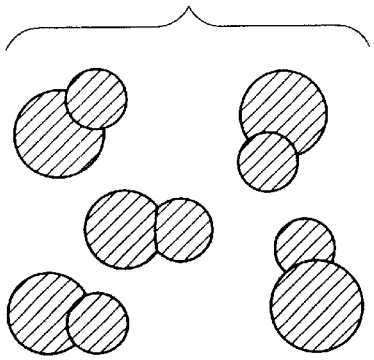
FIGS. 4A, 4B, 4C, 4D and 4E schematically illustrate examples of heteromorphic microspheres used in the present,invention.
Figure 4B:
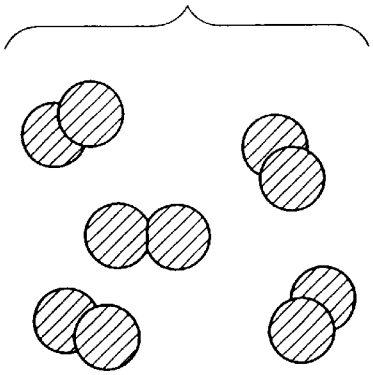

In the present invention, heteromorphic microspheres, which are not spherical and from which the porous resin layer 102 is formed, may be in various forms as illustrated in FIGS. 4A to 4E. Examples of heteromorphic microspheres formed by binding 2 fine particles to each other include those in the form of such a snowman as illustrated in FIG. 4A and in the form of such a dumbbell as illustrated in FIG. 4B.

Figure 4C:
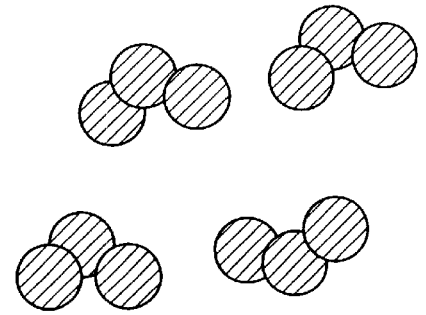
Figure 4D:
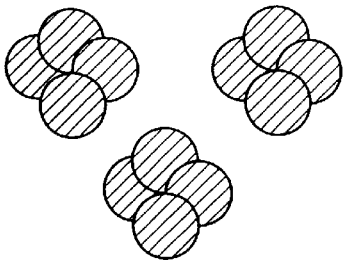
Figure 4E:
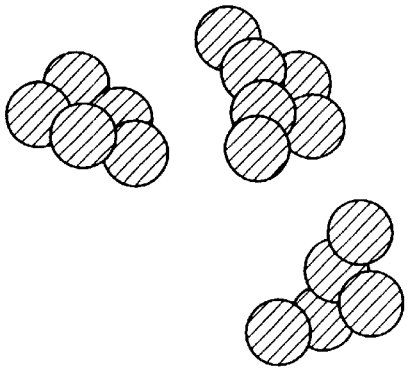

Examples of heteromorphic microspheres formed by binding at least 3 fine particles to one another include those in the form of such a boomerang as illustrated in FIG. 4C, in the form of such a four-leaf clover as illustrated in FIG. 4D and in such an indeterminate form as illustrated in FIG. 4E. The microspheres according to the present invention are preferably those obtained by bonding 2 to 30 fine particles to one another. The use of such microspheres permits the formation of pores greater than the use of individual microspheres (spherical) by reason of bonding of particles to one another.

If the number of fine particles bonded to one another is too great, the form of the resulting microspheres may be varied in some cases, and it may be difficult in some cases to form even pores upon the formation of a porous resin layer because unnecessary interstices are produced in aggregates of the fine particles. The preferable number of fine particles is 3 to 10. Incidentally, the form of the fine particles referred to in the present specification may be out of a sphere and also includes a somewhat deformed form The size of the microspheres according to the present invention is suitably selected according to the applications and shot-in ink quantity of the resulting recording medium. However, the size of the microspheres suitable for ink-jet recording system is preferably 0.1 to 10 $\mu$m in terms of maximum length. If the size is smaller than the lower limit of the above range, any pore having a sufficient size is not formed.

If the size is greater than the upper limit of the above range, pores having an excessively great size are partially formed in the resulting porous resin layer, and so variations in optical density of image, and the like are caused to make the resulting image dull.

A method for producing these heteromorphic microspheres varies according to the size and structure of the microspheres intended. However, basic examples thereof include emulsion polymerization, suspension polymerization and emulsification. In particular, in order to form heteromorphic microspheres like the present invention, it is effective to introduce a monomer into seed particles produced in advance and polymerize the monomer to enlarge the seed particles. This method is referred to as seed polymerization. The method may also be referred to as stage feed polymerization paying attention to polymerization procedure in particular.

When the amount of a stage feed monomer is limited in the seed polymerization so as to make a monomer-exhausted state within particles, thereby conducting polymerization, a propagation reaction progresses side by side at plural sites within individual particles, and consequently heteromorphic particles are grown. At this time, when stage feed polymerization of a crosslinking seed is conducted on seed particles, microspheres in a form that at least two particles are bonded to each other are formed In this mechanism, the monomer is once dissolved in the seed particles by stage-feeding crosslinking seed particles, but it phase-separates from the seed particles due to lowered compatibility when it is converted into a polymer.

At this time, the phase separation continuously occurs so as to lower interfacial energy. As a result, a newly formed polymer is extruded out of meshes of the seed particles to form projections. In this case, the crosslinking structure serves as a propelling force for keeping the original form of the seed particles to extrude the newly formed polymer.

Examples of the resin forming the resin particles in the heteromorphic microspheres used in the present invention include polyester, polyethylene, polyurethane, styrene-acrylic copolymers, polyacrylates, polymethacrylates, ethylene-vinyl acetate copolymers, polystyrene and polyvinyl chloride. However, the resin is not limited to these resins, particles formed of these resins may be used either singly or in any combination thereof if desired.

The lowest film-forming temperature of the heteromorphic microspheres is desirably within a range of from 40 to 150° C. The term "lowest film-forming temperature" as used herein means the lowest temperature at which the resin particles can be formed into a uniform film when they are applied as a coating and then heated.

In order to form a porous resin layer after the resin particles are uniformly applied in the present invention, it is necessary to conduct heating and drying under such conditions that the resin particles in the form of a heteromorphic microsphere are fusion-bonded to one another to an extent that the resulting film has fixed film strength without forming a dense film to form a porous structure.

The term "porous structure" as used therein means a porous structure obtained by partially bonding the resin particles in the form of a heteromorphic microsphere to one another by heating so as to absorb inks therein unlike the structure of porous inorganic particles that the particles themselves have pores to absorb inks therein.

The reason why the porous structure for enhancing ink absorbency is provided in the present invention is due to the specific form of the heteromorphic microspheres. More specifically, the effect of steric hindrance can be utilized in the case where the heteromorphic microspheres are arranged compared with the case where the conventional spherical resin particles are applied to and arranged on a substrate to bond them to one another. Accordingly, the thus-formed layer is bulky and contains a greater number of pores. This permits the formation of regular pores unlike the case where spherical particles are forcedly aggregated by containing a gelling agent in a dispersion of the spherical particles upon application thereof, so that The ink absorbency can be uniformly enhanced within the formed layer.

If the lowest film-forming temperature is lower than 40° C., the densification of the coating is caused to progress when a coating formulation containing the resin particles is applied and dried, so that it is difficult to provide a porous structure, thereby inhibiting the penetration of a solvent (water) in an ink to cause ink running, bleeding and the like upon recording. It is also possible to lower the drying temperature so as not to form a dense film. However, such a method takes a long time to dry the coating because the solvent in the coating formulation applied becomes difficult to dry.

If the lowest film-forming temperature exceeds 150° C., a temperature in a heat treatment after ink-jet recording must be raised, which causes a problem that a substrate and a pigment and/or a dye in an ink are decomposed, oxidized or discolored. The more preferable lowest film-forming temperature is within a range of from 50 to 130° C.

Figure 5:
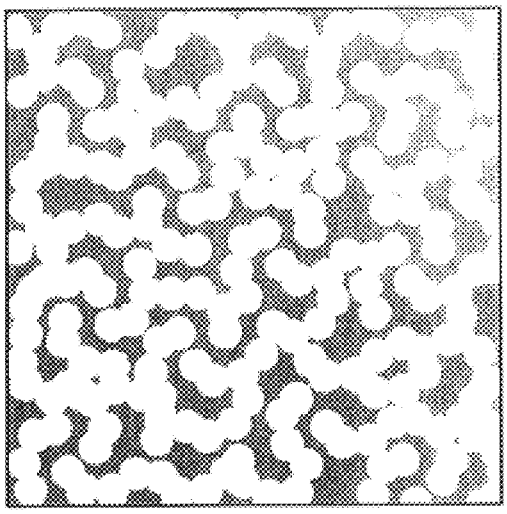
FIG. 5 illustrates a porous structure formed of resin particles in the form of a heteromorphic microsphere.

FIG. 5 illustrates the porous structure of a porous resin layer obtained by partially bonding resin particles in the form of a heteromorphic microsphere to one another under the above proper heating conditions.

The thickness of the porous resin layer 102 is preferably 1 to 70 $\mu$m. If the thickness is smaller than 1 $\mu$m, the coating film can not fulfill a role as an ink-receiving layer, and moreover when an ink containing a pigment as a component is used, its function of absorbing the pigment is also lowered.

Further, although an ink can enter pores formed among the resin particles when the thickness of the porous resin layer is sufficient, effects such as light fastness and ozone fastness are also reduced in the case where an ink containing a dye as a component is used if the thickness is too thin.

If the thickness is too great on the other hand, and particularly exceeds 70 $\mu$m, cracking and the like may occur in the resulting porous resin layer upon drying, so that its strength is lowered, and evenness of the coating film is impaired. Therefore, transparency of the resulting recording medium and brightness of an image formed thereon are deteriorated. The more preferable thickness of the porous resin layer is 3 to 50 $\mu$m.

In the present invention, an organic binder may be contained in the porous resin layer in order to make the fusion bonding among the resin particles in the form of a heteromorphic microsphere stronger. As the binder referred to herein, a thermoplastic resin is used. Any thermoplastic resin may be used herein so far as it exhibits softening and fluidity at a temperature lower than the resin particles in the form of a heteromorphic microsphere. It is preferably a water-soluble or water-dispersible polymer.

Examples of the water-soluble polymer include polyvinyl alcohol or modified products thereof (cationically modified, anionically modified, silanol modified), starch or modified products thereof (oxidized, etherified), gelatin or modified products thereof, casein or modified products thereof, gum arabic and cellulose derivatives such as carboxymethyl cellulose, hydroxyethyl cellulose and hydroxypropylmethyl cellulose.

Examples of the water-dispersible polymer include conjugated diene copolymer latexes such as SBR latexes, NBR latexes and methyl methacrylate-butadiene copolymers, functional group-modified polymer latexes, vinyl copolymer latexes such as ethylene-vinyl acetate copolymers, polyvinyl pyrrolidone, maleic anhydride polymer or copolymers thereof, acrylic ester copolymers, and polyurethane and polyolefin latexes.

These binders may be used either singly or in any combination thereof. In the case of water-dispersible polymer particles, its particle diameter is preferably small so as not to inhibit the formation of the pores formed by binding the resin particles in the form of a heteromorphic microsphere to one another. The particle diameter is preferably smaller than 0.1 $\mu$m.

A mixing ratio of the resin particles in the form of a heteromorphic microsphere to the organic binder is preferably within a range of from 20:1 to 1:1 in terms of a weight ratio. If the amount of the organic binder is less than the lower limit of the above range, its effect as the binder is hard to obtain. If the amount is greater than the upper limit of the above range, the pore volume of the pores to be formed is reduced, resulting in a recording medium poor in ink absorbency.

In the present invention, porous inorganic particles may be contained in the porous resin layer 102 for enhancing the ink absorbency of the porous resin layer. Specific examples of the porous inorganic particles include silica, alumina hydrate, calcium carbonate, magnesium carbonate, magnesium oxide, kaolin, talc, calcium sulfate, barium sulfate, titania, zinc oxide, zinc carbonate, silicic acid, sodium silicate, magnesium silicate, calcium silicate and clay. Examples of inorganic particles preferably used from the viewpoints of ink absorbency and resolution in particular include silica and alumina hydrate.

As the silica, there may be used any of natural silica, synthetic silica, amorphous silica and chemically modified silica compounds. However, silica having a positive charge is particularly preferably used. Since the alumina hydrate has a positive charge, a dye in an ink is well fixed thereto, and an image is high in gloss and good in coloring can hence be provided. In addition, a porous resin layer having a low haze degree and high transparency can be provided.

The content of the porous inorganic particles in the porous resin layer is preferably 3 to 25% by weight based on the total solids content in the porous resin layer. If the content is lower than 3% by weight, their effect becomes little. If the content is higher than 25% by weight on the other hand, cracking, dusting and the like occurs in the resulting porous resin layer. It is hence not preferable to contain the porous inorganic particles outside the above range.

The porous resin layer can be formed by applying a coating formulation obtained by optionally mixing the organic binder and porous inorganic particles into a dispersion of the resin particles in the form of a heteromorphic microsphere to a substrate to form a coating film.

The coating formulation itself preferably has a pH of 3 to 7. When the porous resin layer is formed using a coating formulation having a pH lower than 3, the ink applied to the porous resin layer upon recording may tend to undergo color change in some cases when the pH is higher than 7 on the other hand, the coating formulation tends to increase its viscosity, and so its stability with time may be deteriorated in some cases.

To the coating formulation, there may be further added a cationizing agent, surfactant, water-proofing agent, dispersing agent, thickener, pH adjuster, lubricant, flowability modifier, antifoaming agent, foam suppressor and/or the like within limits not impeding the object of the present invention.

Of these, the cationizing agent is an effective additive because the water fastness of an image recorded with an ink on the resulting recording medium can be improved.

Specific examples of the cationizing agent includes the hydrochlorides and acetates of laurylamine, stearylamine, rosin amine and the like; compounds of the quaternary ammonium salt type, such as ammonium salts of acrylic esters, ammonium salts of polyacrylic esters, benzyltributylammonium chloride, lauryltrimethylammonium chloride and benzalkonium chloride; pyridinium salt type compounds; imidazoline type cationic compounds; and ethylene oxide adducts of higher alkylamines.

The surfactant is an effective additive for preventing coating defects such as cissing when the coating formulation is applied to the substrate. Specific examples of the surfactant include anionic surfactants such as carboxylic acid salts, sulfonic acid salts, sulfate salts and phosphate salts; cationic surfactants such as aliphatic amine salts, aliphatic quaternary ammonium salts, aromatic quaternary ammonium salts and heterocyclic quaternary ammonium salts; nonionic surfactants such as polyoxyethylene alkyl ethers, polyoxyethylene alkyl phenyl ethers, polyoxyethylene glycerol fatty acid esters and polyoxyethylene alkylamines; and amphoteric surfactants such as aminocarboxylic acid salts and imidazoline derivatives.

No particular limitation is imposed on the coating method of the coating formulation, and the coating may be conducted by means of a roll coater, air knife coater, blade coater, bar coater, gravure coater, rod coater, curtain coater, die coater or the like. The drying is conducted at a temperature lower than the lowest film-forming temperature of the resin particles in the form of a heteromorphic microsphere by a hot-air drying oven, infrared drying oven or the like commonly used, or any combination thereof.

No particular limitation is imposed on the substrate 101 used in the present invention, and various kinds of substrates may be used. Examples of usable substrates include paper webs such as suitably sized paper, water leaf paper and resin-coated paper, resin films and sheets, cloths, glass, and metals. As the resin films and sheets, may be used transparent films and sheets formed of polyester, polystyrene, polyvinyl chloride, polymethyl methacrylate, cellulose acetate, polyethylene or polycarbonate, as well as opaque films and sheets opacified by the filling of an alumina hydrate, titanium white or the like, or the formation of foams.

When a transparent film is used as the substrate, the resulting recording medium can also be used as a sheet for OHP (overhead projector) or in the formation of medical images as a X-ray film or the like. When an opaque plastic film containing a white pigment, or paper is used as the substrate, the resulting recording medium can also be used in a field of photographic images like photoprints. Further, various kinds of color pigments may be contained in a substrate to make it translucent or colored, thereby controlling the color tone of the whole image.

The substrate may be subjected to a surface treatment such as a corona discharge treatment for improving its adhesiveness to the porous resin layer, i.e., an ink-receiving layer, or provided with an easy-adhesion layer as an undercoat. Further, a curl-preventing layer such as a resin layer or a pigment layer for preventing curling may be provided on the back surface of the substrate or at a desired position thereof. No particular limitation is imposed on the thickness of the substrate as well. The thickness of the substrate may be suitably selected as necessary for the end application intended, and is often from 5 $\mu$m to 500 $\mu$m.

The present invention is also suitably applied to a recording medium of a two-layer structure as illustrated in FIG. 2, in which a porous inorganic particle layer 103 formed basically of porous inorganic particles and an organic binder, and a porous resin layer 102 comprising heteromorphic microsphere are successively formed on a substrate 101. Namely, the relationship between the absorbing capacity and absorbing speed of the porous resin layer 102 and the porous Inorganic particle layer 103 as illustrated in FIG. 2 is optimized, whereby high absorbing ability is achieved. Namely, the resulting recording medium can be suitably used in printing by a printer from which a great amount of an ink is ejected.

Therefore, an Image high in optical density of image and gradation can be provided. More specifically, the absorbing capacity of the porous inorganic particle layer 103 of a lower layer is made greater than that of the porous resin layer 102 of an upper layer, whereby most of a solvent is absorbed in the porous inorganic particle layer 103, so that the solvent is prevented from running in lateral directions in the porous resin layer 102.

A dot diameter of the ink impacted can be optimized by adjusting the balance of ink absorption among all the layers in such a manner, so that a bright or clear image can be recorded. Besides, the absorbing speed of the porous resin layer 102 of the upper layer is made higher than that of the porous inorganic particle layer 103 of the lower layer, whereby the solvent in the ink impacted can be transferred to the lower layer immediately after printing, so that a possibility of feathering at the surface can be further reduced, and an image higher in resolution can be formed.

The porous inorganic particle layer 103 functions as an absorbing layer for the solvent component in the ink and moreover as a fixing layer for a dye component when the ink contains the dye component, and assumes most of the ink absorption by the whole ink-absorbing layer of the recording medium. Therefore, it is desirable to have a great ink-absorbing capacity in particular.

In order to secure a sufficient ink-absorbing capacity, it Is necessary to adjust the pore diameter of the porous inorganic particle layer. At this time, it is desirable that the average pore diameter be 10 nm or smaller, and any pore exceeding 10 nm be substantially not present. If the average pore diameter exceeds 10 nm, light scattering occurs on the resulting porous inorganic particle layer, so that the transparency of the recording medium is impaired, and moreover an image formed thereon by printing becomes whity. Therefore, such a great average pore diameter is not preferred Incidentally, the pore diameter distribution is determined by the nitrogen adsorption and desorption method.

In order to adjust the absorbing capacity, it is also desirable that the total pore volume of the porous inorganic particle layer be within a range of from 0.1 to 1.0 cc/g, preferably from 0.4 to 0.6 cc/g. If the pore volume of the porous inorganic particle layer is greater than the upper limit of the above range, cracking and dusting tend to occur upon the formation of porous inorganic particle layer. If the pore volume is smaller than the lower limit of the above range, the porous inorganic particle layer becomes poor in ink absorption. It is further desirable that the pore volume per unit area of the porous inorganic particle layer be at least 8 $cc/m^3$. If the pore volume per unit area is smaller than this limit, the ink-absorbing ability assumed by the porous inorganic particle layer becomes insufficient, so that inks tend to run out of the porous inorganic particle layer when multi-color printing is conducted in particular, and so bleeding occurs on an image formed.

As the inorganic particles used in the porous inorganic particle layer, preferred porous inorganic particles. The particle diameter thereof is preferably from 20 to 500 nm Examples of inorganic particles preferably used from the viewpoints of ink absorbency and resolution in particular include silica and alumina hydrate. In particular, the use of the alumina hydrate permits the provision of a porous inorganic particle layer having a low haze degree and high transparency.

The binder used in combination with the above inorganic particles is preferably a water-soluble or water-dispersible polymer. Examples of the polymer used include polyvinyl alcohol or modified products thereof (cationically modified, anionically modified, silanol modified), starch or modified products thereof (oxidized, etherified), gelatin or modified products thereof, SBR latexes, NBR latexes, carboxymethyl cellulose, hydroxyethyl cellulose, hydroxypropylmethyl cellulose, and polyvinyl pyrrolidone, maleic anhydride polymers or copolymers thereof, and acrylic ester copolymers. These binders may be used either singly or in any combination thereof.

The mixing ratio of the inorganic particles to the organic binder is within a range of from 1:1 to 30:1 in terms of a weight ratio. If the amount of the organic binder is less than the lower limit of the above range, the mechanical strength of the resulting porous inorganic particle layer becomes insufficient, which forms the cause of cracking and dusting. If the amount is greater than the upper limit of the above range, the ink absorbency of the resulting porous inorganic particle layer is deteriorated. The particularly preferred range of the mixing ratio is from 5:1 to 20:1.

A coating formulation is obtained by using the above-described porous inorganic particles and binder. This coating formulation is applied to a substrate, whereby the porous inorganic particle layer can be formed.

To the coating formulation, there may be further added additives such as dispersing agents, pH adjusters, water-proofing agents and surfactants as necessary for the end application intended.

No particular limitation is imposed on the coating of the coating formulation on the substrate, and the coating may be conducted by means of a roll coater, air knife coater, blade coater, bar coater, gravure coater, rod coater, curtain coater, die coater or the like.

The drying is conducted by a hot-air drying oven, infrared drying oven or the like commonly used, or any combination thereof. The drying conditions may be suitably adjusted according to the composition of the coating formulation used, and the drying is conducted at a temperature at which the solvent (water) in the coating formulation is evaporated, and moreover crosslinking or fusion bonding between the porous inorganic particles and the binder is made.

The thickness of the porous inorganic particle layer 103 formed is preferably from 1 $\mu$m to 100 $\mu$m. If the thickness is smaller than 1 $\mu$m, such an inorganic particle layer becomes insufficient in the ability to fixing and absorbing the colorant, which causes a problem that an image formed on the porous resin layer undergoes feathering and the like. If the thickness of the porous inorganic particle layer exceeds 100 $\mu$m, such an porous inorganic particle layer undergoes lowering In mechanical strength and transparency and occurrence of coating defects upon coating of the coating formulation, which causes a problem that portions incapable of securing a sufficient ink-absorbing capacity partially occur at such an inorganic particle layer. It is hence not preferable to form any porous inorganic particle layer having a thickness outside the above range. The more preferable thickness of the porous inorganic particle layer is 5 to 50 $\mu$m.

In the present invention, a substrate subjected to a releasing treatment and having release property is used as the substrate 101 of the recording medium of the structure illustrated in FIGS. 1 or 2, whereby the resulting recording medium can be provided as an image transfer medium. In this case, the porous resin layer 102 comprising the heteromorphic microspheres fulfills a role as an ink-absorbing layer by virtue of pores formed among the resin particles in the form of a heteromorphic microsphere and moreover has adhesive property to a transfer-printing medium. Therefore, a resin, which can be melted at a lower temperature and has a lower glass transition point, among the resins mentioned above for the heteromorphic microspheres is preferably used.

FIG. 3 Illustrates a structure suitable for use in transfer printing, i e., a recording medium of a two-layer structure, in which a hot-melt resin layer 104 comprising a thermoplastic resin having a low melt viscosity upon transfer printing and a porous resin layer 102 comprising resin particles in the form of a heteromorphic microsphere are successively formed on a substrate 101. The hot-melt resin layer 104 fulfills a role of reinforcing adhesive property and has no need to have ink absorbency in particular so far as it becomes low in melt viscosity upon transfer printing, has good adhesive property and penetrates into interstices in a transfer-printing medium comprising fibers or the like to develop strong adhesive force.

Examples of the thermoplastic resin used in the hot-melt resin layer include polyester resins, acrylic resins, vinyl chloride resins, polyethylene resins, vinyl acetate resins, polypropylene resins, polyethylene oxide resins and polyvinylidene chloride resins. A mixture obtained by adding a tackifier, a plasticizer, oil, wax, etc. to such a thermoplastic resin is used as a hot-melt resin.

A coating method of the hot-melt resin, is used the conventional coating method for hot-melt resins suitably using a die coater, roll coater, fountain coater or the like. In order to smooth the surface of the resulting coating layer and control the thickness thereof, the coating layer may be subjected to a post processing such as pressing as needed.

The thickness of the hot-melt resin layer 104 is suitably selected as necessary for the end application intended, but is preferably within a range of from 10 to 80 $\mu$m. If the thickness is smaller than 10 $\mu$m, its adhesive force to a transfer-printing medium when the resin is melted cannot be enhanced If the thickness is greater than 80 $\mu$m, the flexibility of the resulting image-transfer medium is impaired. The porous resin layer 102 comprising the resin particles in the form of a heteromorphic microsphere is formed on the hot-melt resin layer 104 according to the above-described process, thereby providing a recording medium of a two-layer structure, which can be applied to transfer printing.

As examples of a means for conducting recording on the thus-obtained recording media according to the present invention, may be mentioned recording instruments and recording apparatus using recording agent-containing inks, such as felt pens, pen plotters, ink mist, ink-jet and various printing machines. The ink-jet recording apparatus and pen plotters are preferred from the viewpoint of permitting high-speed recording of images, and the ink-jet recording apparatus are desirable from the viewpoint of providing high-resolution images As inks used in the present invention, may be used the conventionally known water-based and/or oil-based inks.

As coloring materials contained in inks, may be used colorants such as the conventionally known dyes and pigments and/or materials having coloring ability Preferable examples of dyes used in ink-jet recording include water-soluble dyes represented by direct dyes, acid dyes, basic dyes, reactive dyes and food colors As pigments, various kinds of carbon black, pigment yellow, pigment red and pigment blue, etc. are used. Inks containing a pigment are preferably used as necessary for the end application intended from the viewpoints of the attainment of a particularly high optical density of image and resistance to fading.

In the present invention, the formation of an image is completed by heating the recording medium at a temperature not lower than the lowest film-forming temperature of the heteromorphic microspheres forming the porous resin layer 102 after conducting the recording according to the above-described process, thereby making the pores dense to form the whole resin layer into a film. The porous resin layer 102 is made transparent by making the pores dense to provide a bright image. The coloring material in the ink forming the image is sealed with the film to provide a print high in light fastness, water fastness and ozone fastness.

When the porous resin layer 102 is transferred to an image-transfer medium, the recording medium is laminated on the transfer-printing medium with the porous resin layer opposed to the transfer-printing medium, and the recording medium is then heated and pressed at a temperature not lower than the lowest film-forming temperature of the heteromorphic microspheres, from which the porous resin layer is formed, from the side of the substrate of the recording medium, thereby making the pores in the porous resin layer dense to form a strong film and at the same time transferring the porous resin layer to the transfer-printing medium. The formation of an image is completed in this manner. In this case, it is naturally necessary to record a mirror image of an image obtained by recording with an ink.

The heat treatment for making the porous resin layer dense is carried out in a hot-air drying oven or infrared drying oven, or on a hot plate, which is commonly used. These devices may be used in combination. The heating may be conducted from the front side, back side or both sides of a print. Pressing may be used in combination with the heat treatment. At this time, the melting by the heat treatment is facilitated by the pressing. Therefore, the densification of the resin layer is accelerated, so that the treatment can be conducted in a shorter period of time.

Specifically, the recording medium is passed through heated rolls used in lamination and the like and then through cooling rolls to complete the heat treatment. When the surface of each roll is planished, a smoother surface may be provided. When the surface of each roll 13 roughened on the other hand, a matte surface may also be provided.

When the porous resin layer is transferred, heating and pressing are required and conducted by means of the conventionally known hot press, heated rolls, iron or the like.

The present invention will hereinafter be described in detail by the following Examples with reference to the accompanying drawings. However, the present invention is not limited to these examples.

EXAMPLE 1

A commercially available form paper web (thickness: 100 $\mu$m) comprising cellulose was used as a substrate 101. In order to apply a coating formulation comprising polymer colloid with heteromorphic microspheres dispersed therein to this substrate to form a porous resin layer 102, a coating dispersion was prepared in accordance with the following process.

A kneader was first charged with 100 parts by weight of an ethylene-propylene copolymer elastomer [ethylene content: 75% by mol, MFR: 0.2 g/10 min, density: 0.88 g/cm$^3$, Sp value: 7.97 (cal/cm$^3$)$^{1/2}$] as a thermoplastic resin, 10 parts by weight of a maleic anhydride-grafted polyethylene [maleic anhydride content: 3.3% by weight, Mw: 2,700, density: 0.94 g/cm$^3$, sp value: 8.06 (cal/cm$^3$)$^{1/2}$, —CO—C— group content: 0.67 mmol equivalent/g] as a thermoplastic polymer and 5 parts by weight of oleic acid as an organic compound converted into an anionic surfactant by reacting with a basic substance, and the resultant mixture was kneaded at 125° C. for 20 minutes.

Then, 15 parts by weight of alkaline water with 1.38 parts by weight (1.0 chemical equivalent) of potassium hydroxide, which was required to neutralize all carboxylic acids of the thermoplastic polymer and organic compound, dissolved therein were introduced under pressure into the kneader by means of a pump connected to the kneader over 5 minutes. The pressure within the kneader was raised to 3 kg/cm$^3$G. After kneading was then continued for 30 minutes, the kneader was cooled to 60° C. and opened. As a result, a white viscous substance was given.

To this product were added 315 parts by weight of water, and the mixture was stirred to obtain a dispersion having a solids content of 30% and a viscosity of 65 cP. The size of particles dispersed was determined by a Coulter counter and found to be 1.9 $\mu$m in terms of an average particle diameter (maximum length).

Figure 8:
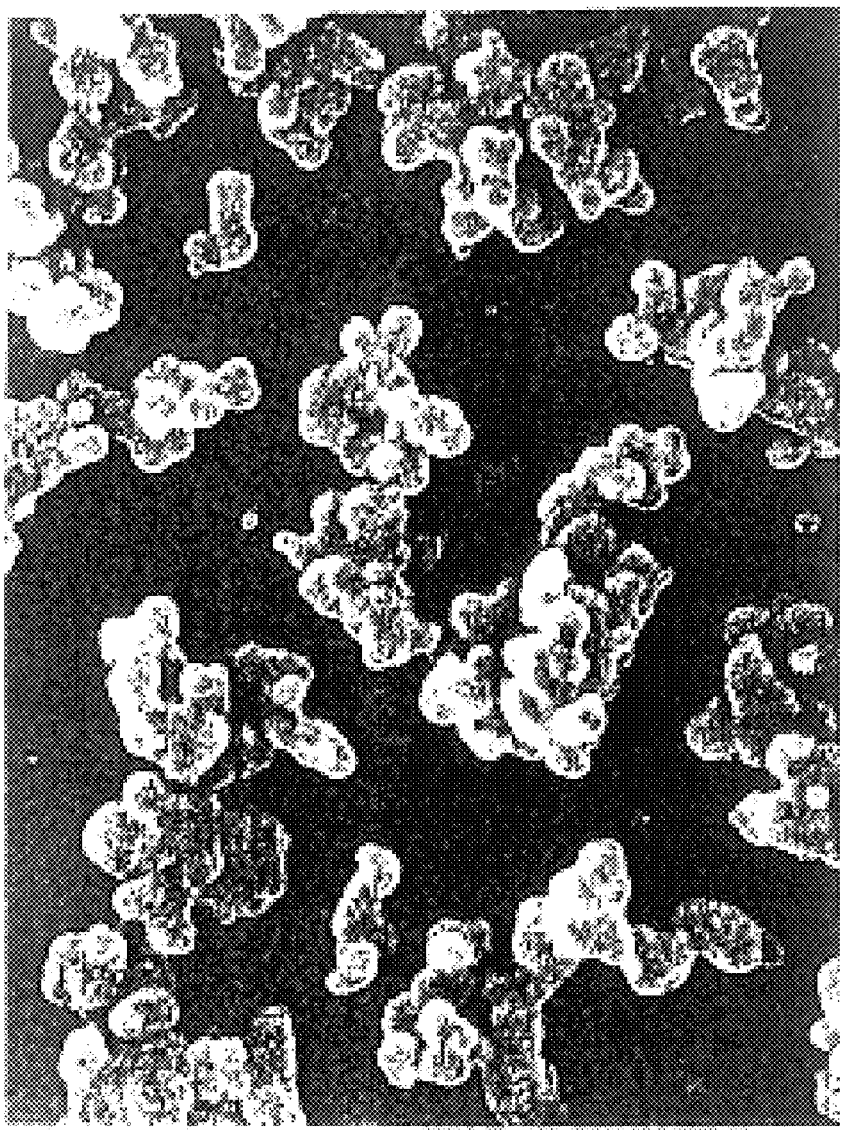
FIG. 8 is an electron photomicrograph illustrating the structure of heteromorphic microspheres used in EXAMPLE 1.

The dispersed particles were observed through an electron microscope and found to be heteromorphic microspheres of a form that such fine particles different from spheres as illustrated in FIG. 8 were bonded to one another. FIG. 8 is an electron photomicrograph of 10,000 magnifications. In order to improve leveling ability upon coating of the dispersion, a surfactant (FZ-2162, trade name, product of Nippon Unicar Co., Ltd.) was added to the dispersion in a proportion of 0.5% by weight based on the dispersion to obtain a coating dispersion.

The coating dispersion was die-coated on the substrate 101 by means of a coater and a hot-air drying oven (both, not illustrated) and then dried (drying temperature: 50° C.) to form a porous resin layer 102 having a thickness of 35 $\mu$m, thereby obtaining a recording medium 100 as shown in FIG. 1. The porous structure of the recording medium viewed from the surface thereof was such that a great number of bulky pores are evenly formed as illustrated in FIG. 5.

The thus-produced recording medium was cut into A4 sizes to print a design pattern on the resultant recording medium sample by means of an ink-jet printer (BJC-430J, manufactured by Canon Inc.), thereby evaluating the recording medium sample as to the following items (1) to (4). The evaluation results are shown in Table 1. In the present invention, the test samples were judged to be acceptable where they were not ranked as C in all the evaluation items.

Evaluation:

(1) Ink-absorbing Speed (drying property):

The time until a print sample no longer became smeared even when the printed area of the sample was lightly rubbed with a finger after the printing was measured, and the sample was evaluated in accordance with the following standard:

A: Within 10 seconds;
B: Within 60 seconds;
C: Smeared even after 60 seconds.

(2) Ink-absorbing Ability (resistant to bleeding and beading):

The printed area of a print sample was visually observed to confirm whether bleeding and beading occurred or not. The ink-absorbing ability of the recording medium sample was evaluated in accordance with the following standard:

AA: Neither bleeding nor beading occurred;
A: No bleeding occurred;
B: Only beading somewhat occurred;
C: Bleeding occurred.

(3) Print Quality:

The printed area of a print sample was visually observed to confirm evenness and clarity of dots. The print quality was evaluated in accordance with the following standard:

AA: Dots were even and clear;
A: Dots were even;
B: Dots were uneven;
C: Dots were not clear.

(4) Film Strength:

The film strength was determined by confirming whether separation of a porous resin layer of the recording medium sample occurred or not during printing, and evaluated in accordance with the following standard:

AA: The porous resin layer was hard to be damaged;
A: No separation occurred;
C: Separation occurred.

After printing by the above-printer, the pores in the porous resin layer 102 were made dense by means of a heat-fixing machine (not illustrated) to form the whole resin layer into a film, thereby completing the fixing of an image. The fixing was conducted for 1 minute under conditions of 160° C. Thereafter, the thus-obtained print sample was evaluated as to the following items (5) and (6). The evaluation results are shown in Table 1. In the present invention, the test samples were judged to be acceptable where they were not ranked as C in all the evaluation items (5) Storage Stability (temperature, humidity):

A fixed print sample was placed in an environmental tester capable of holding at a temperature of 45° C. and a relative humidity of 95% and left to stand. After 240 hours, the sample was taken out and observed as to print quality and the degree of color change (fading). The storage stability of the print sample was evaluated in accordance with the following standard:

A: No change occurred;
B: Bleeding or fading occurred to a slight extent;
C; Very conspicuous bleeding or absolute fading occurred.

(6) Storage Stability (light fastness, ozone fastness):

A fixed print sample was left to stand indoors for 3 months to observe the degree of color change (fading). The storage stability of the print sample was evaluated in accordance with the following standard:

A: No change occurred;
B: Fading occurred to a slight extent;
C: Absolute fading occurred.

Comparative Example 1

Figure 6:
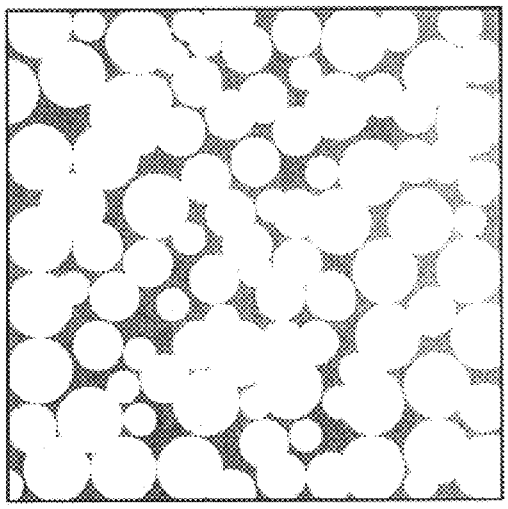
FIG. 6 illustrates a porous structure formed of the conventional spherical resin particles.

Coating and drying were contacted in the same manner as in EXAMPLE 1 except that a dispersion of spherical particles having a particle diameter (average particle diameter: 1.9 $\mu$m) almost equal to that of the heteromorphic microspheres used in EXAMPLE 1 was used as a coating formulation, thereby forming a porous resin layer to obtain a recording medium. The porous structure of the recording medium viewed from the surface thereof was such that the spherical particles were densely arranged, and the number of pores was small as illustrated in FIG. 6. Thereafter, evaluation was conducted in the same manner as in EXAMPLE 1. The evaluation results are shown in Table 1.

Comparative Example 2

Figure 7:
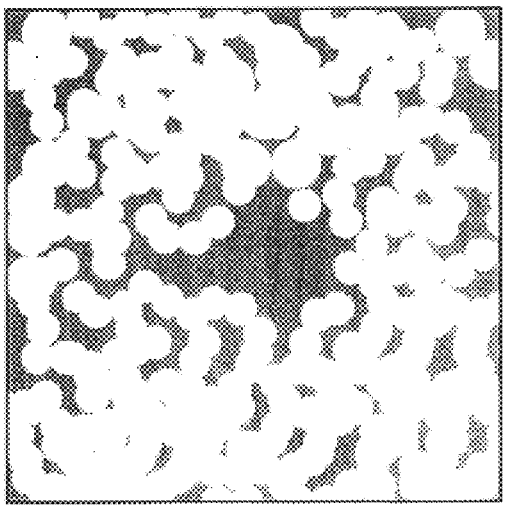
FIG. 7 illustrates a porous structure obtained by gelling the conventional spherical resin particles.

To 100 parts by weight of a dispersion of spherical particles having a particle diameter (average particle diameter: 1.9 μm) almost equal to that of the heteromorphic microspheres used in EXAMPLE 1 were added, as a gelling agent, 6 parts by weight of a 48% aqueous solution of a zinc complex of ammonium sulfate prepared by adding 108 parts by weight of 25% aqueous ammonia to 100 parts by weight of zinc sulfate, and the resultant mixture was stirred to prepare a coating formulation. The coating formulation was applied and dried in the same manner as in EXAMPLE 1 to form a porous resin layer, thereby obtaining a recording medium. The porous structure of the recording medium viewed from the surface thereof was such that the formation of pores is uneven because the spherical particles were forcedly gelled to make the pores bulky, and the particles underwent partial fusion bonding to produce portions free of any pore as illustrated in FIG. 7. Thereafter, evaluation was conducted in the same manner as in EXAMPLE 1. The evaluation results are shown in Table 1.

EXAMPLE 2

A recording medium was obtained in exactly the same manner as in EXAMPLE 1 except that a coating dispersion obtained by adding 10% by weight of silica particles (P78A, trade name, product of Mizusawa Industrial Chemicals, Ltd.) as porous inorganic particles to the coating dispersion prepared in EXAMPLE 1 in order to improve absorbency was used. Thereafter, evaluation as to the items (1) to (4) was conducted in the same manner as in EXAMPLE 1.

The pores in the porous resin layer 102 were then made dense by means of a heat-fixing machine (not illustrated) to form the whole resin layer into a film, thereby completing the fixing of an image. Thereafter, the evaluation as to the items (5) and (6) was conducted. The evaluation results are shown in Table 1.

EXAMPLE 3

A recording medium was obtained in exactly the same manner as in EXAMPLE 1 except that a coating dispersion obtained by adding 3.0% by weight of polyvinyl acetate emulsion (PS-10, trade name, product of Showa Highpolymer Co., Ltd.) as an organic binder to the coating dispersion prepared in EXAMPLE 1 in order to improve film strength was used. Thereafter, evaluation as to the items (1) to (4) was conducted in the same manner as in EXAMPLE 1.

The pores in the porous resin layer 102 were then made dense by means of a heat-fixing machine (not illustrated) to form the whole resin layer into a film, thereby completing the fixing of an image. Thereafter, the evaluation as to the items (5) and (6) was conducted. The evaluation results are shown in Table 1.

EXAMPLE 4

The same porous resin layer 102 as in EXAMPLE 1 and a porous inorganic particle layer 103 were formed as upper and lower layers, respectively, on a substrate 101 to produce such a recording medium 200 as illustrated in FIG. 2. A white polyester film (thickness: 100 μm ) was used as the substrate 101. In order to form the porous inorganic particle layer 103 on this substrate, a coating dispersion was prepared in accordance with the following process.

Aluminum dodeoxide was first hydrolyzed to prepare an alumina slurry. Water was added to the alumina slurry until the solids content of alumina hydrate reached 7.9%. After a 3.9% nitric acid solution was then added to this slurry to adjust the pH of the slurry, the slurry was aged to obtain colloidal sol. This colloidal sol was spray-dried at 75° C. to obtain an alumina hydrate. The alumina hydrate was dispersed in ion-exchanged water to prepare a 15% aqueous dispersion. Polyvinyl alcohol (Gohsenol NH18, trade name, product of The Nippon Synthetic Chemical Industry Co., Ltd.) was then dissolved and dispersed in ion-exchanged water to obtain a 10% aqueous solution. The alumina hydrate dispersion and the polyvinyl alcohol solution were mixed so as to give a mixing ratio of 10:1 by weight, and the resultant mixture was stirred to prepare a coating dispersion. This coating dispersion was die-coated on the substrate using a coater and an hot-air drying oven (both, not illustrated) and then dried (drying temperature: 140° C.), thereby forming the porous inorganic particle layer 103 having a thickness of 35 μm.

In order to form the porous resin layer 102, the same coating dispersion as that used in EXAMPLE 1 was then die-coated on the porous inorganic particle layer 103 using a coater and an hot-air drying oven (both, not illustrated) and then dried (drying temperature: 60° C.) to form the porous resin layer 102 having a thickness of 18 μm, thereby obtaining a recording medium.

This recording medium was evaluated as to the items (1) to (4) in the same manner as in EXAMPLE 1.

The pores in the porous resin layer 102 were then made dense by means of a heat-fixing machine (not illustrated) to form the whole resin layer into a film, thereby completing the fixing of an image. Thereafter, the evaluation as to the items (5) and (6) was conducted. The evaluation results are shown in Table 1.

EXAMPLE 5

The same porous resin layer 102 as in EXAMPLE 2 and a hot-melt resin layer 104 were formed as upper and lower layers, respectively, on a substrate 101 to produce such a recording medium 300 as illustrated in FIG. 3. Glassine paper (thickness: 95 μm) was used as the substrate 101. In order to form the hot-melt resin layer 104 on this substrate, a coating dispersion was prepared and applied in accordance with the following process.

First, 20% by weight of an ethylene-vinyl acetate copolymer (Everflex 210ET, trade name, product of Mitsui-Du Pont Chemicals Co., Ltd.), 20% by weight of a terpene resin (Clearon M115., trade name, product of Yasuhara Chemical Co., Ltd.) and 6% by weight of ethylene wax (Neowax L, trade name, product of Yasuhara Chemical Co., Ltd.) were mined to one another, and the mixture was coated on the substrate using a hot-melt coater (not illustrated), thereby forming the hot-melt resin layer 104 having a thickness of 60 μm.

In order to form the porous resin layer 102, the same coating dispersion as that used in EXAMPLE 1 was then die-coated on the hot-melt resin layer 104 using a coater and an hot-air drying oven (both, not illustrated) and then dried (drying temperature: 60° C.) to form the porous resin layer 102 having a thickness of 18 μm, thereby obtaining a recording medium. This recording medium was evaluated as to the items (1) to (4) in the same manner as in EXAMPLE 1.

The printed surface of the recording medium was brought into contact with a cotton fabric, and they were heated by means of a hot press (not illustrated) from the side of the substrate, thereby transferring the porous resin layer 102 and hot-melt resin layer 104 to the fabric. Thereafter, the evaluation as to the items (5) and (6) was conducted. -The evaluation results are shown in Table 1.

TABLE 1

| | Example | | | | | Comp. Ex. | |
|---|---|---|---|---|---|---|---|
| | 1 | 2 | 3 | 4 | 5 | 1 | 2 |
| (1) Ink-absorbing speed | A | A | A | A | A | B | A |
| (2) Ink-absorbing capacity | A | AA | A | AA | A | C | A |
| (3) Print quality | A | AA | A | AA | A | B | B |
| (4) Film strength | A | A | AA | A | A | A | C |
| (5) Storage stability (temperature, humidity) | A | A | A | A | A | A | B |
| (6) Storage stability (light fastness) | A | A | A | A | A | A | B |
| Judgment on evaluation | Acceptance | | | | | Rejection | |

According to the present invention, as described above, at least one porous resin layer comprising heteromorphic microspheres is formed on a substrate, whereby such a layer can develop high ink absorbency as an ink-absorbing layer by virtue of pores formed by arrangement and bonding of the resin particles to provide high-quality images having high and even optical density.

According to the present invention, there can also be provided recording media which permits the provision of images having excellent water fastness and light fastness and withstanding long-term storage, have a strong film and are easy to handle, and an image forming process which can actually achieve excellent image quality and permits the formation of an image by transfer printing.

What is claimed is:

1. A recording medium for use in ink-jet recording comprising a substrate and at least one porous resin layer formed on the substrate, wherein the porous resin layer comprises heteromorphic microspheres formed of a thermoplastic resin.

2. The recording medium according to claim 1, wherein the heteromorphic microspheres are in the form that 2 to 30 fine resin particles are bonded to one another.

3. The recording medium according to claim 1, wherein the porous resin layer comprises an organic binder.

4. The recording medium according to claim 1, wherein the porous resin layer comprises porous inorganic particles.

5. The recording medium according to claim 1, which further comprises a porous inorganic particle layer between the substrate and the porous resin layer.

6. The recording medium according to claim 5, wherein the porous inorganic particle layer comprises porous inorganic particles and an organic binder.

7. The recording medium according to claim 1, which further comprises a hot-melt resin layer between the substrate and the porous resin layer.

8. The recording medium according to claim 7, wherein the hot-melt resin layer comprises a thermoplastic resin.

9. The recording medium according to claim 1, wherein the substrate is a substrate having release property.

10. An image forming process, comprising the steps of:

ejecting an ink by an ink-jet recording system on the porous resin layer of the recording medium according to any one of claims 1, 2, 3 or 4 to conduct recording, and then heating the recording medium at a temperature not lower than the lowest film-forming temperature of the heteromorphic microspheres, from which the porous resin layer is formed, thereby forming the porous resin layer into a film.

11. An image forming process, comprising the steps of:

ejecting an ink by an ink-jet recording system on the porous resin layer of the recording medium according to any one of claims 1, 2 or 3 to 9 to conduct recording, laminating the recording medium on a transfer printing medium with the porous resin layer opposed to the transfer-printing medium, and then heating and pressing the recording medium at a temperature not lower than the lowest film-forming temperature of the heteromorphic microspheres, from which the porous resin layer is formed, from the side of the substrate of the recording medium, thereby transferring the porous resin layer to the transfer-printing medium.

12. A process for producing a recording medium having at least one porous resin layer on a substrate, which comprises the steps of:

applying a coating formulation comprising polymer colloid, in which heteromorphic microspheres are dispersed, to the substrate, and drying the coating formulation at a temperature lower than the lowest film-forming temperature of the heteromorphic microspheres, thereby forming the porous resin layer.

13. The process according to claim 12, wherein the heteromorphic microspheres are in the form that 2 to 30 fine resin particles are bonded to one another.

14. The process according to claim 12, wherein the coating formulation, in which porous inorganic particles and an organic binder are dispersed, is applied to the substrate, and dried at a temperature at which crosslinking or fusion bonding between the porous inorganic particles and the binder is made, or higher, thereby forming the porous resin layer.

15. The process according to claim 12, wherein the coating formulation comprising the polymer colloid, in which the heteromorphic microspheres are dispersed, substantially contains no gelling agent.

16. The process according to claim 12, wherein the porous resin layer is formed after a resin material composed mainly of a thermoplastic resin is melt-coated on the substrate.

* * * * *

UNITED STATES PATENT AND TRADEMARK OFFICE

CERTIFICATE OF CORRECTION

PATENT NO. : 6,402,316 B1
DATED : June 11, 2002
INVENTOR(S) : Hirofumi Ichinose

It is certified that error appears in the above-identified patent and that said Letters Patent is hereby corrected as shown below:

Column 1,
Line 51, “Involves” should read -- involves --.

Column 2,
Line 50, “that-the” should read -- that the --.

Column 3,
Line 8, “Substrate,” should read -- substrate, --; and
Line 65, “present,invention.” should read -- present invention. --.

Column 5,
Line 18, “formed” should read -- formed. --.

Column 6,
Line 2, “The” should read -- the --.

Column 9,
Line 6, “Inorganic” should read -- inorganic --;
Line 11, “Image” should read -- image --;
Line 36, “Is” should read -- is --; and
Line 46, “ferred” should read -- ferred. --.

Column 10,
Line 1, “500 nm” should read -- 500 nm. --;
Line 59, “an” should read -- a --; and
Line 60, “In” should read -- in --.

Column 11,
Line 15, “Illustrates” should read -- illustrates --;
Line 35, “A” should read -- As a --; and “is used” should be deleted.
Line 37, “like,” should read -- like is used. --; and
Line 46, “enhanced” should read -- enhanced. --.

UNITED STATES PATENT AND TRADEMARK OFFICE

CERTIFICATE OF CORRECTION

PATENT NO. : 6,402,316 B1
DATED : June 11, 2002
INVENTOR(S) : Hirofumi Ichinose

It is certified that error appears in the above-identified patent and that said Letters Patent is hereby corrected as shown below:

Column 12,
Line 1, “ability” should read -- ability. --; and
Line 4, “colors” should read -- colors. --.

Column 14,
Line 38, “items” should read -- items. --; and
Line 49, “C;” should read -- C: --.

Column 16,
Lines 20, 27 and 62, “an” should read -- a --; and
Line 55, “mined” should read -- mixed --.

Column 17,
Line 6, “-The” should read -- The --.

Signed and Sealed this

Twenty-fifth Day of March, 2003

JAMES E. ROGAN
*Director of the United States Patent and Trademark Office*